US011629006B1

(12) United States Patent
Johnson

(10) Patent No.: US 11,629,006 B1
(45) Date of Patent: Apr. 18, 2023

(54) LEAVES AND YARD DEBRIS COLLECTION AND DISPOSAL BAG

(71) Applicant: Kian Johnson, Bridgewater, NJ (US)

(72) Inventor: Kian Johnson, Bridgewater, NJ (US)

( * ) Notice: Subject to any disclaimer, the term of this patent is extended or adjusted under 35 U.S.C. 154(b) by 0 days.

(21) Appl. No.: 17/398,069

(22) Filed: Aug. 10, 2021

(51) Int. Cl.
*B65F 1/00* (2006.01)

(52) U.S. Cl.
CPC ..... *B65F 1/002* (2013.01); *B65F 2240/138* (2013.01)

(58) Field of Classification Search
CPC ..... B65F 1/002; B65F 2240/138
USPC ..... 383/74
See application file for complete search history.

(56) References Cited

U.S. PATENT DOCUMENTS 2,740,445 A * 4/1956 Fornell ..... D06F 95/004 383/41
3,150,640 A * 9/1964 Nevitt ..... A61D 3/00 383/41
4,773,585 A * 9/1988 Lehrman ..... D06F 95/004 383/23
4,955,068 A 9/1990 Tennihan
5,065,143 A 11/1991 Greaves
5,066,143 A * 11/1991 Sanders ..... B65F 1/0006 383/7
5,219,219 A * 6/1993 Virdin, Jr. ..... A47G 11/003 206/541
6,758,596 B2 7/2004 McDonough
9,167,874 B2 * 10/2015 Shlafer ..... A47G 9/062
2006/0008182 A1 * 1/2006 Ingraselino ..... B65F 1/0006 383/4
2006/0018568 A1 * 1/2006 Costello ..... B65F 1/00 383/117
2014/0355910 A1 * 12/2014 Ferris ..... B65F 1/00 383/105
2017/0253428 A1 * 9/2017 Tobin ..... B65F 1/002
2018/0022483 A1 * 1/2018 Lenon, III ..... B65D 33/28 53/469

FOREIGN PATENT DOCUMENTS

KR 20080103718 A * 11/2008
KR 20180040989 A * 4/2018
KR 20180095390 A * 8/2018
KR 20200099829 A * 8/2020

OTHER PUBLICATIONS

Machine translation of KR-20180040989-A.*
Machine translation of KR-20080103718-A.*
Machine translation of KR-20180095390-A.*

* cited by examiner

*Primary Examiner* — Jes F Pascua
(74) *Attorney, Agent, or Firm* — Sanchelima & Associates, P.A.; Christian Sanchelima; Jesus Sanchelima

(57) ABSTRACT

A leaves and yard debris collection and disposal container including a container having a flexible tarp with an integral draw string. The draw string includes a slide fastener opening in the center bottom end. The exterior of the container includes handles. Wherein yard debris and leaves are piled up in the center of the container and the edges of the container can be lifted up and tightened over the pile using the draw string and the grip pad and tighten with a lace lock. Then the bag can be lifted and carried using handles and emptied by opening the slide fastener closure located at the bottom of the container.

8 Claims, 3 Drawing Sheets

LEAVES AND YARD DEBRIS COLLECTION AND DISPOSAL BAG

BACKGROUND OF THE INVENTION

1. Field of the Invention

The present invention relates to a leaves and yard debris collection and disposal container and, more particularly, to a leaves and yard debris collection and disposal container that includes a container, wherein refuse is collected. An integral draw string at the upper end to seal the container, and a fastener placed centered at the bottom end for disposal of the refuse.

2. Description of the Related Art

Several designs for a leaves and yard debris collection and disposal container have been designed in the past. None of them, however, include a spring lock and a slide fastener opening in the center/bottom.

Applicant believes that a related reference corresponds to U.S. Pat. No. 5,066,143 issued for a leaf bagging equipment. Applicant believes that another related reference corresponds to U.S. Pat. No. 4,955,068 issued for a round flat ground mat with draw strings for drawing the edges up to form a bag wherein the mat is used to collect and dispose of yard debris. Applicant believes that still another related reference corresponds to U.S. Pat. No. 6,758,596 issued for a yard debris collection and disposal bag comprising handles to assist in lifting and carrying the bag. None of these references, however, teach of a spring lock and a slide fastener centered at the bottom for disposal.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a leaves and yard debris collection and disposal container that is easy to use, compact and space saver, re-usable, weather resistant and easy to manufacture.

It is another object of this invention to provide a leaves and yard debris collection and disposal container that includes a slide fastener centered at the bottom end of the container for ease of disposal of refuse.

It is still another object of the present invention to provide a leaves and yard debris collection and disposal container that includes a draw string and spring lock for ease of locking without the need of tying the string.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
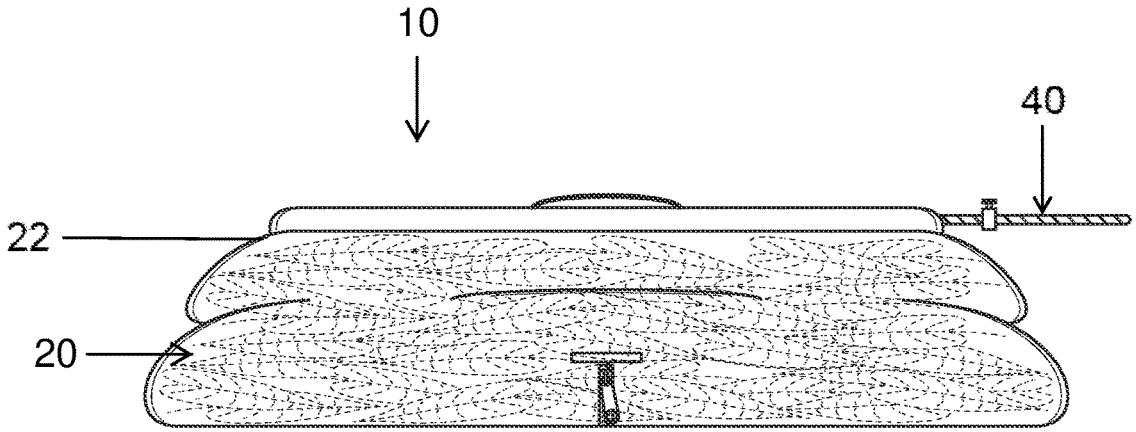
FIG. 1 represents an operational view of the present invention 10 with refuse stored within the container 22 of the container assembly 20. In the present embodiment the container 22 includes a top portion with a drawstring assembly 40 mounted thereon. The drawstring assembly 40 may help maintain the refuse within the container 22.

Referring now to the drawings, where the present invention is generally referred to with numeral 10, it can be observed that it basically includes a container assembly 20, and a draw string assembly 40. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 2:
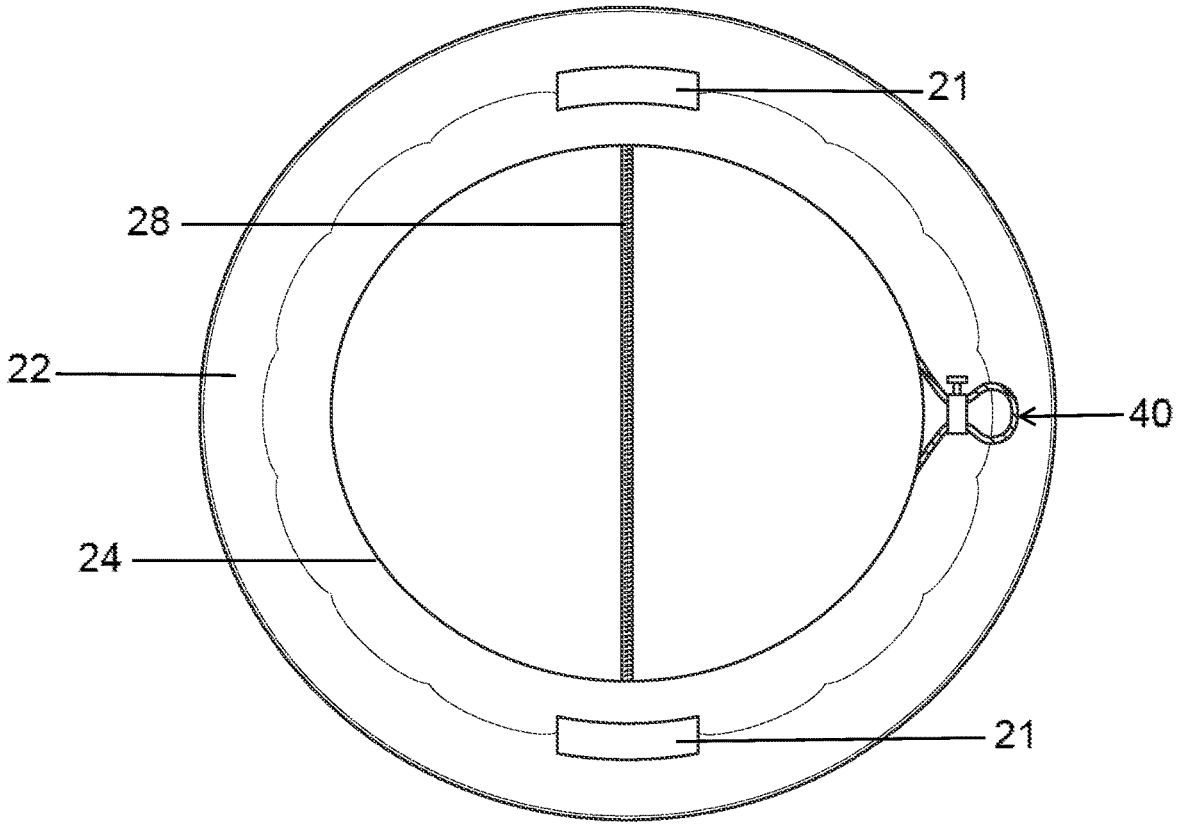
FIG. 2 shows a top view showing the upper part of the present invention 10, wherein through the upper opening 24 of the container 22, a fastener 28, centered at the bottom, is shown. The fastener 28 may be a zipper and in the present embodiment is closed. The drawstring assembly 40 surrounds the upper opening 24 of the container 22. Next to the draw string assembly 40, two handles 21 are placed side to side for easy carrying.
Figure 3:
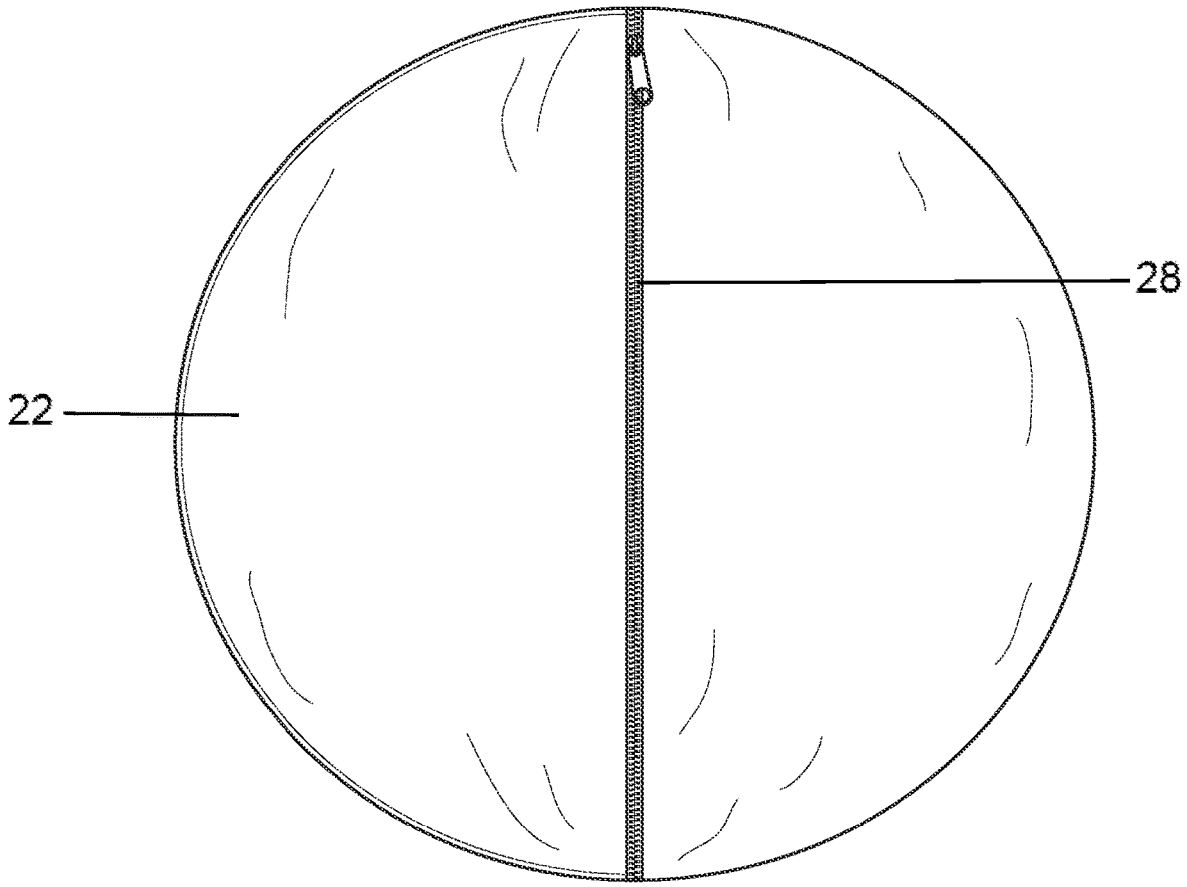
FIG. 3 illustrates a bottom view showing centered at the bottom end of the container 22 a fastener 28. The fastener 28 may be a zipper and in the present embodiment is closed.

Best illustrated in FIG. 1-3 the container assembly 20 may include a container 22. In one embodiment the container 22 may be made of a tarp. It may be preferable for the tarp to be flexible and flat. The container 22 may have a substantially round shape, or any other of a plurality of shapes thereon. The container 22 may be made of common plastic, biodegradable plastic, oxo-biodegradable plastic or any other variation thereof. It may be suitable for the container 22 to be compact and unfoldable to save space when the present invention 10 is not in use; to be ecofriendly and reusable to reduce the use of non-biodegradable plastics. In one embodiment, the container 22 may come in a plurality of sizes depending on the requirements of a user. The container 22 may also include and upper opening 24 placed at the upper end of the container 22. At the lower end of the container 22, an opening that may be placed at the center of the container 22 may be used to mount a fastener 28. The fastener 28 may be a slide fastener such as a zipper, or a hook and loop fastener, or a flexible interlocking profile zip track, or any other variation suitable to be opened and closed with ease for a long period of time. The upper opening 24 may be substantially wide for the container 22 to be placed at a floor and the refuse collected in the middle of the upper opening 24. The container 22 may be lifted and carried using two handles 21 and emptied by opening the fastener 28 at the bottom end of the container 22. The handles 21 may be placed at opposite sides of the upper end of the container 22 right next to the portion of the draw string assembly 40 that surrounds the upper opening 24 of the container 22. In one embodiment, the handles 21 may be made of a semi rigid material capable to conform to the hands of a user.

Figure 4:
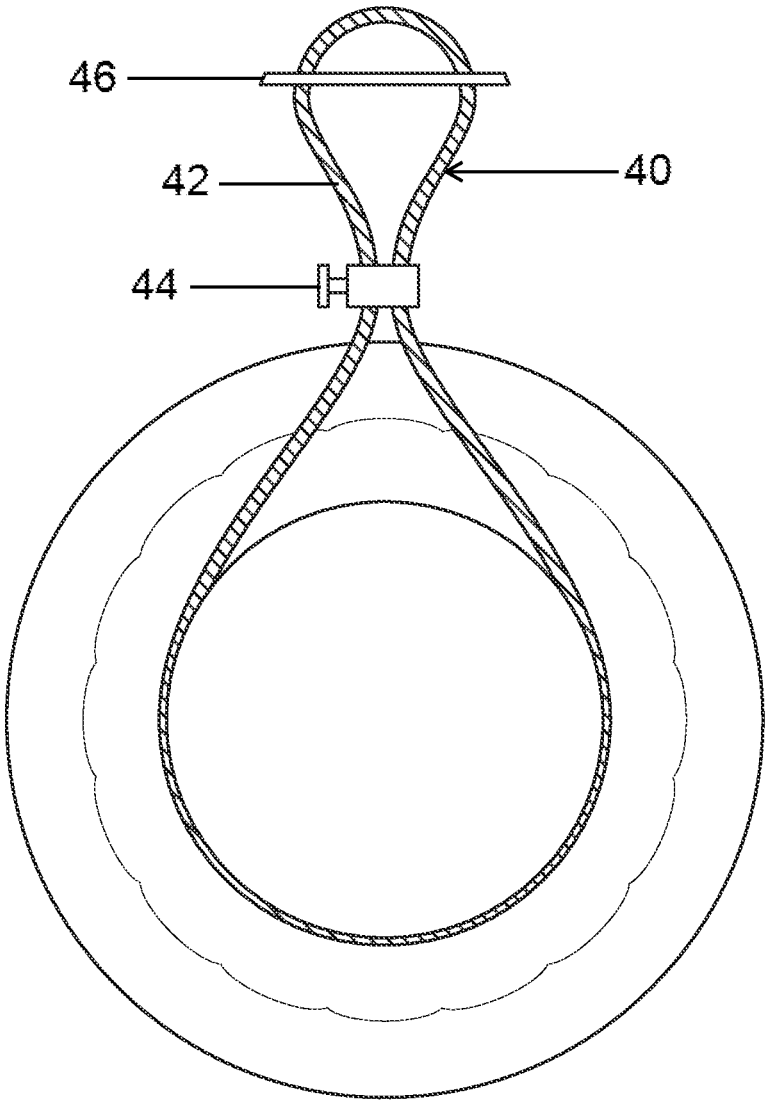
FIG. 4 represents an enlarged view of the drawstring assembly 40 having a drawstring 42. The drawstring 42 may be pulled by a grip pad 46 placed near the end of the drawstring loop and may be squeezed by a spring lock 44 that may be a lace lock.

Best shown in FIG. 4 an integral draw string assembly 40 may include a drawstring 42. The drawstring 42 may be made of cord, braid, leather, ribbons, rope or any other kind of material that is foldable and pliable. The drawstring 42 may be attached right next to and surrounding the upper opening 24 of the container 22, wherein in one embodiment, refuse such as yard debris and leaves may be piled up in the center of the container 22 and the edges of the container 22 can be pulled and lifted up and tightened over the pile by pulling the drawstring 42 with a grip pad 46. The grip pad 46 may be mounted near the visible end of the drawstring 42. It may be suitable for the grip pad 46 to be made of a pliable material capable of resisting the pulling of a hand without breaking over time, but also be gentle to a user's hand skin. The drawstring 42 may be tighten by a spring lock 44 for ease of use, eliminating the time consuming task of tying the string and moving on quicker to the next task at hand. In one embodiment, the spring lock 44 may be a lace lock that may be a three part lock including a barrel, a toggle/plunger and a spring. The spring lock 44 may be made of plastic, or a lightweight metallic material, or any variation thereof.

In one embodiment, the drawstring 42 may be mounted to the container 22 via stitching, in order for the drawstring 22 to be able to tighten and seal refuse inside the container 22, and also to loosen the upper opening 24 to be ready to be used again. The drawstring 42 may be closed loop, wherein a portion of the drawstring may be hidden and enclosed by the container 22. The grip pad 46 surrounds a part of the exposed portion of said drawstring. The spring lock 48 is mounted right after the enclosed portion of the drawstring 42 ends and the drawstring 42 becomes visible. The two handles 21 are mounted next to the hidden portion of the drawstring 42 and placed opposite to each other.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A leaves and yard debris collection and disposal container, comprising:

a. a container assembly including a container wherein the container has a circular shape when empty that conforms a bag-shaped body when fill with refuse, wherein said bag-shaped body is flexible to conform with the shape of a debris that is placed therein, said container includes a fastener embedded within a straight opening at a lower end of said container for disposal of refuse, wherein said fastener is a zipper mechanism, and an upper opening at an upper end of said container; and b. a drawstring assembly including a drawstring, wherein said drawstring is mounted about said upper opening of the container, wherein said drawstring surrounds a portion of a circumference of said upper opening, said drawstring includes a spring lock wherein said spring lock is a plastic toggle spring, a portion of said drawstring extends past said circumference of said upper opening, wherein a grip pad is coupled between two portion of said drawstring, said drawstring seals the refuse contained inside said container when said drawstring is pulled by said grip pad and tightened by said plastic toggle spring.

2. The container of claim 1 wherein said opening located at said lower end thereof is configured to be opened and closed by means of a zipper mechanism.

3. The fastener of claim 1, wherein said fastener is mounted along a circumference of said opening of said lower end of said container.

4. The container of claim 1 wherein said container has two handles, wherein said two handles are placed in a top portion of said container, said two handles are oppositely placed one from each other.

5. The handles of claim 4, wherein said two handles have a curved shape, wherein said two handles are made of a semi-rigid material capable of conforming with a user's hand.

6. The drawstring of claim 1 wherein said grip pad is configured to be pulled by a user's hand, thereby said grip pad is made of a pliable material preventing said grip pad from breaking when pulled.

7. A leaves and yard debris collection and disposal container, comprising:

a. a container assembly including a container wherein the container has a circular shape when empty that conforms a bag-shaped body when fill with refuse, wherein said bag-shaped body is flexible to conform with the shape of refuse placed therein, said container includes a fastener embedded along a circumference of a straight opening at a lower end of said container, wherein said fastener is a zipper mechanism, said zipper mechanism of said container is configure to be closed for containing refuse and is configured to be opened to dispose refuse contained therein, said container further includes an upper opening at an upper end of said, wherein said upper opening is substantially in circular shape, container assembly further includes two handles attached to an upper portion of said container; and b. a drawstring assembly including a drawstring, and a spring lock wherein said drawstring is embedded in a portion of a circumference about said upper opening of said container, wherein said spring lock is a plastic toggle spring, wherein a portion of said drawstring extends past said circumference of said upper opening, said spring lock is attached to said portion of said drawstring allowing said drawstring to be tighten by pulling said portion and pressing a button of said spring lock to, a grid pad included in the drawstring assembly is coupled between two portions of said portion that extends past said circumference of said upper opening, wherein said grid pad is configured to be pulled by a user's hand, said drawstring seals the refuse contained inside said container when pulled by said grip pad and tightened by said plastic toggle spring.

8. A leaves and yard debris collection and disposal container, consisting of:

a. a container assembly including a container, an upper opening, two handles, and a fastener wherein the container has a circular shape when empty that conforms a bag-shaped body when fill with refuse, wherein said bag-shaped body is flexible to conform with the shape of refuse placed therein, said fastener is embedded along a circumference of a straight opening at a lower end of said container, wherein said fastener is a zipper mechanism, said zipper mechanism of said container is configure to be closed for containing refuse and is configured to be opened to dispose refuse contained therein, said upper opening is placed at an upper end of said container, wherein said upper opening is substantially in circular shape, said two handles attached to an upper portion of said container, wherein said two handles are placed oppositely one from each other, said handles are made of a semi-rigid material capable of conforming to a user's hand when carried; and b. a drawstring assembly including a drawstring, a spring lock and a grip pad, wherein said drawstring is embedded in a portion of a circumference about said upper opening of said container, wherein said spring lock is a plastic toggle spring, wherein a portion of said drawstring extends past said circumference of said upper opening, said spring lock is attached to said portion of said drawstring allowing said drawstring to be tighten by pulling said portion and pressing a button of said spring lock to, said grid pad is coupled between two portions of said portion that extends past said circumference of said upper opening, wherein said grid pad is configured to be pulled by a user's hand, said drawstring seals the refuse contained inside said container when pulled by said grip pad and tightened by said plastic toggle spring.

* * * * *